US011189405B2

(12) United States Patent
Rong et al.

(10) Patent No.: US 11,189,405 B2
(45) Date of Patent: Nov. 30, 2021

(54) COMPOSITE MAGNET WITH MAGNETICALLY HARD AND SOFT PHASES

(71) Applicant: FORD GLOBAL TECHNOLOGIES, LLC, Dearborn, MI (US)

(72) Inventors: Chuanbing Rong, Canton, MI (US); Michael W. Degner, Novi, MI (US); Feng Liang, Troy, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 162 days.

(21) Appl. No.: 16/270,115

(22) Filed: Feb. 7, 2019

(65) Prior Publication Data

US 2020/0258663 A1 Aug. 13, 2020

(51) Int. Cl.
*H01F 1/03* (2006.01)
*H01F 1/057* (2006.01)
(Continued)

(52) U.S. Cl.
CPC ..... *H01F 1/0306* (2013.01); *H01F 1/047* (2013.01); *H01F 1/058* (2013.01); *H01F 1/0571* (2013.01); *H01F 1/0579* (2013.01); *H01F 1/147* (2013.01); *H01F 41/0266* (2013.01); *B22F 3/02* (2013.01); *B22F 2301/355* (2013.01)

(58) Field of Classification Search
CPC .. B22F 2301/355; B22F 3/02; B22F 2998/10; H01F 1/0306; H01F 1/0571; H01F 1/058; H01F 1/147; H01F 41/0266; H01F 1/047; H01F 1/0556; H01F 1/0576; H01F 1/0579; H01F 1/08; H01F 1/22; H01F 7/021;
(Continued)

(56) References Cited

U.S. PATENT DOCUMENTS 6,078,237 A * 6/2000 Nomura ..... B82Y 25/00 252/62.54
2006/0005898 A1 1/2006 Liu et al.
(Continued)

OTHER PUBLICATIONS

Li et al. (2018), Micromagnetic simulation on magnetic properties of Nd2Fe14B/α-Fe nanocomposites with Fe nanowires as the soft phase (Year: 2018).*
(Continued)

*Primary Examiner* — Mark Ruthkosky
*Assistant Examiner* — Rebecca L Grusby
(74) *Attorney, Agent, or Firm* — David B. Kelley; Brooks Kushman P C

(57) ABSTRACT

According to an embodiment, a composite permanent magnet includes a matrix of magnetically hard phase grains having an average grain size of 10 nm to 50 μm; and magnetically soft phase grains embedded within the matrix, and having an average grain size of at least 50 nm, each grain having an elongated shape with an aspect ratio of at least 2:1. According to another embodiment, a composite permanent magnet includes a matrix of magnetically hard phase grains having an average grain size of 10 nm to 50 μm; and magnetically soft phase grains embedded within the matrix, and having an average grain width of at least 50 nm, an average grain height of 20 to 500 nm, and an aspect ratio of at least 2:1. According to yet another embodiment, a method of forming a composite permanent magnet is also provided.

17 Claims, 3 Drawing Sheets

(51) Int. Cl.

| | |
|---|---|
| ***H01F 1/058*** | (2006.01) |
| ***H01F 41/02*** | (2006.01) |
| ***H01F 1/147*** | (2006.01) |
| ***H01F 1/047*** | (2006.01) |
| ***B22F 3/02*** | (2006.01) |

(58) Field of Classification Search
CPC ... H01F 41/0273; H01F 1/036; C22C 1/0433; C22C 1/0441; C22C 33/0278; C22C 2202/02
See application file for complete search history.

(56) References Cited

U.S. PATENT DOCUMENTS

| | | | | |
|---|---|---|---|---|
| 2010/0054981 | A1* | 3/2010 | Liu | B29B 9/12 419/19 |
| 2014/0132376 | A1* | 5/2014 | Jin | H01F 1/0552 335/302 |
| 2017/0330657 | A1* | 11/2017 | Arnold | C23C 18/31 |
| 2018/0166189 | A1 | 6/2018 | Turgut | |

OTHER PUBLICATIONS

Rong, C. "Fabrication of bulk nanocomposite magnets via severe plastic deformation and warm compaction" doi: 10.1063/1.3358390 (Year: 2010).*

* cited by examiner

COMPOSITE MAGNET WITH MAGNETICALLY HARD AND SOFT PHASES

TECHNICAL FIELD

The present disclosure relates to a permanent magnet, and more specifically to a permanent magnet with magnetically hard and soft phases.

BACKGROUND

Permanent magnets have a wide application due to persisted permanent flux. Rare-earth permanent magnets, such as Nd—Fe—B or Sm—Co permanent magnets, include rare earth elements which display excellent hard magnetic performance, evidenced by high coercivity, high flux density, and, therefore, high energy density. Conventional Sm—Co and Nd—Fe—B magnets are costly due to low natural occurrence and have limited magnetic performance improvement capability.

One approach to improving magnetic performance in Sm—Co and Nd—Fe—B permanent magnets is to add a magnetic soft phase, such as Fe and/or Fe—Co. The magnetic soft phase has a high magnetic flux density which increases the remanence of the final magnet, and thus improves the resultant energy product application. Conventional composite magnets are formed by adding the magnetically soft phase into NdFeB or SmCo, however these magnets do not achieve the magnetic performance over conventional sintered Nd—Fe—B magnets because although remanence is enhanced, coercivity is sacrificed.

Another approach to add magnetically soft phases into the magnetically hard phases include using nanocomposite technology, such as melt-spinning, ball milling, or other similar techniques. In magnets prepared from those methods, the grain size of the magnetically soft phase is extremely small, i.e., less than 100 nm. Typically, to achieve good magnetic performance through the inter-grain exchange coupling between two magnetic phases, the magnetically soft phase must have a larger grain size, for example, around 10 nm.

SUMMARY

According to an embodiment, a composite permanent magnet comprises a matrix of magnetically hard phase grains having an average grain size of 10 nm to 50 μm. The composite permanent magnet also comprises magnetically soft phase grains embedded within the matrix, the magnetically soft phase grains having an average grain size of at least 50 nm, and each grain having an elongated shape with an aspect ratio of at least 2:1.

According to one or more embodiments, both the magnetically hard and soft phase grains may have a crystallographic texture. In one or more embodiments, the magnetically hard phase grains may be NdFeB, SmCo5, MnBi, Sm—Fe—C, or combinations thereof. In at least one embodiment, the magnetically soft phase grains may be Fe, Co, FeCo, Ni, or combinations thereof. According to some embodiments, the magnetically soft phase grains may have an average grain width of at least 50 nm, and an average grain height of 20 to 500 nm. In some embodiments, the aspect ratio may be at least 10:1. In one or more embodiments, the magnetically soft phase grains may have an oval grain shape, elliptical grain shape, layered grain shape, flake grain shape, or combinations thereof According to another embodiment, a composite permanent magnet comprises a matrix of magnetically hard phase grains having an average grain size of 10 nm to 50 μm; and magnetically soft phase grains embedded within the matrix, and having an average grain width of at least 50 nm, an average grain height of 20 to 500 nm, and an aspect ratio of at least 2:1.

According to one or more embodiments, the magnetically hard phase grains may be NdFeB, SmCo5, MnBi, Sm—Fe—C, or combinations thereof. In one or more embodiments, the magnetically soft phase grains may be Fe, Co, FeCo, Ni, or combinations thereof. In at least one embodiment, both the magnetically hard and soft phase grains may have a crystallographic texture. According to one or more embodiments, the magnetically soft phase grains may have an oval grain shape, elliptical grain shape, layered grain shape, flake grain shape, or combinations thereof According to yet another embodiment, a method of forming a composite permanent magnet comprises providing magnetically hard phase grains having an average grain size of 10 nm to 50 μm, and magnetically soft phase grains having an elongated shape with an average grain size of at least 50 nm and an aspect ratio of at least 2:1; mixing the magnetically hard and soft phase grains at a ratio of up to 50% wt. to form a mixture; hot-compacting the mixture to form a compact; and hot-deforming the compact to form a composite permanent magnet with elongated magnetically soft phase grains embedded in a magnetically hard phase matrix.

According to one or more embodiments, the magnetically soft phase grains may have an average grain size of 50 nm to 10 μm. In at least one embodiment, the magnetically soft phase grains may have an oval grain shape, elliptical grain shape, layered grain shape, flake grain shape, or combinations thereof. In one or more embodiments, the aspect ratio may be at least 10:1. According to at least one embodiment, the hot-compacting may be conducted at a temperature of 550-800° C., for a pressing time of 5 to 30 minutes, under a pressure of 100 MPa to 2 GPa. In at least one embodiment, the hot-deforming may be conducted at a temperature of 600-850° C., for a pressing time of 5 to 60 minutes, under a pressure of 100 MPa to 1 GPa such that a deformation speed may be controlled by a pressure increasing speed or a press ram displacement speed. According to at least one embodiment, the method may further include milling the mixture without destroying a microstructure of the magnetically hard phase. In some embodiments, the magnetically hard phase grains may be NdFeB, SmCo5, MnBi, Sm—Fe—C, or combinations thereof, and the magnetically soft phase grains may be Fe, Co, FeCo, Ni, or combinations thereof.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Moreover, except where otherwise expressly indicated, all numerical quantities in this disclosure are to be understood as modified by the word "about" in describing the broader scope of this disclosure. Practice within the numerical limits stated is generally preferred. Also, unless expressly stated to the contrary, the description of a group or class of materials by suitable or preferred for a given purpose in connection with the disclosure implies that mixtures of any two or more members of the group or class may be equally suitable or preferred.

According to embodiments of the present disclosure, a composite permanent magnet includes a magnetically hard phase and magnetically soft phase, wherein, in some embodiments, the grain size of the magnetically soft phase grains (or grain cluster, i.e., multiple grains together, hereinafter collectively referred to as magnetically soft phase grains) may be larger than 50 nm. Furthermore, the grain shape of the composite permanent magnet is an elongated shape, such as, but not limited to, an elliptical shape, flake shape, or layered shape. The composite permanent magnet has improved texture formation (e.g., anisotropy) when compared to conventional nanocomposite permanent magnets because of the size of the magnetically hard and soft phases, thus having good inter-grain coupling. Furthermore, the microstructure of the magnetically hard and soft phases provides a good coupling when compared with conventionally sintered magnets and the conventional nanocomposite magnets, thus improving performance of the composite permanent magnet (i.e., remanence and energy product density). Further, in some embodiments, by replacing the conventional soft phase with a semi-hard magnetic phase having a higher coercivity than the conventional soft phase, the overall coercivity of the magnet can be improved.

Figure 1:
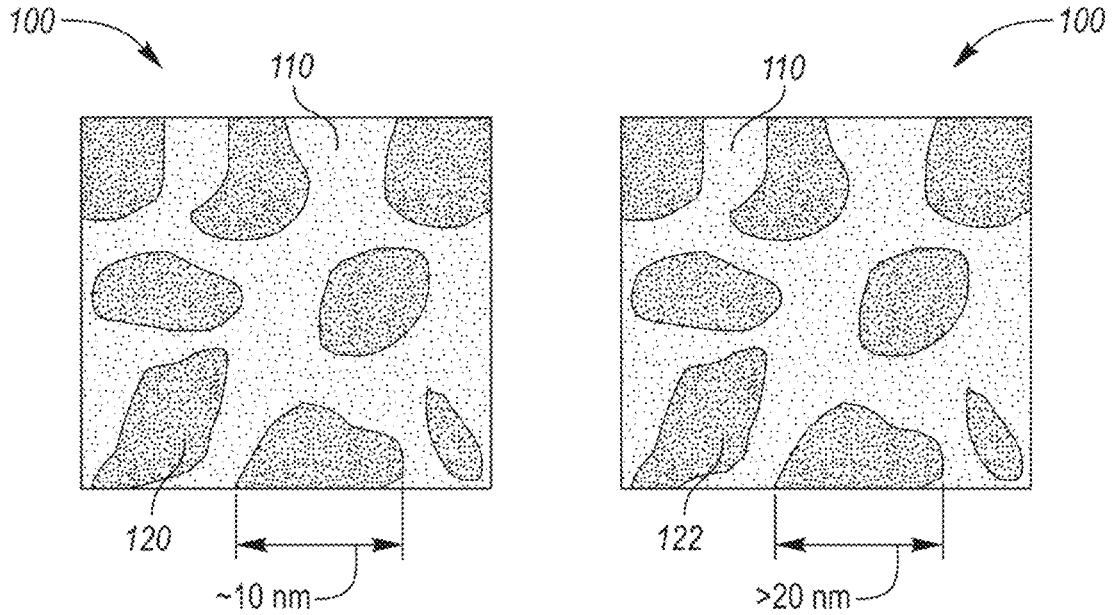
FIG. 1 (PRIOR ART)
FIG. 1 shows schematic diagram of conventional composite permanent magnets with various sizes of magnetic soft phases.
Figure 2:
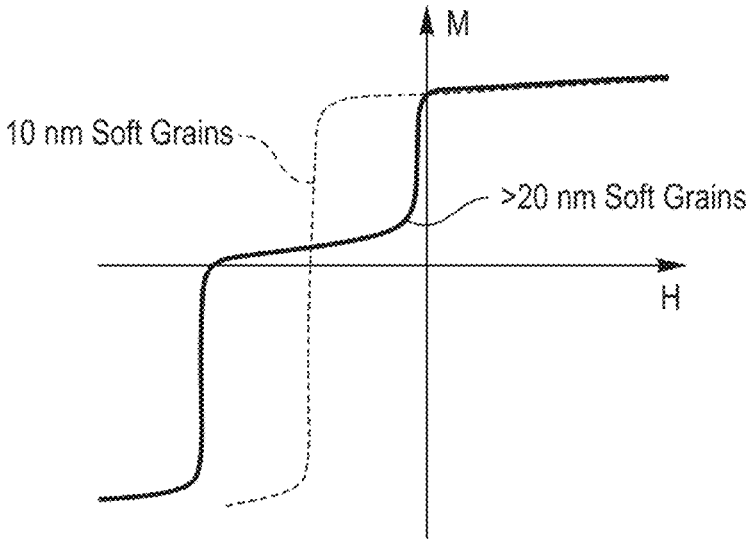
FIG. 2 (PRIOR ART)
FIG. 2 is a graph showing the hysteresis curves of conventional composite magnets with different magnetically soft phase sizes.

Referring to FIG. 1, in conventional nanocomposite permanent magnets 100, to improve magnetic performance such as remanence (Br) and energy product $(BH)_{max}$, a hard magnetic phase 110 (e.g., Nd—Fe—B or Sm—Co) is combined with an aligned soft magnetic phase 120, 122 (e.g., Fe and/or Fe—Co). To achieve remanence enhancement without scarifying coercivity, the average grain size of soft phase 120 in conventional permanent magnets is 10 nm, as shown in FIG. 1(*a*). When particles have such small average grain sizes formed via processes such as melt-spinning and ball-milling, it is difficult to develop texture in the permanent magnet, which limits magnetic performance. The dashed line of FIG. 2 showing the curve for 10 nm material is an artificial curve because textured material is difficult to form in grain sizes within that scale. If the strictly controlled microstructure is achieved with the smaller grain size, it generates a good squareness as shown in the schematically illustrated hysteresis loop (M (T or Gauss) vs. H (kA/m or Oe)) of FIG. 2, where the smoothness of the M-H curve shows the coupling between the magnetically hard and soft phase, as the soft phase must be aligned in conventional permanent magnets. However, when the average grain size of the soft phase is larger than 20 to 50 nm, as shown in FIG. 1(*b*), the hysteresis loop will show a kink, as shown in FIG. 2, indicating a lack of sufficient coupling between the magnetically hard and soft phases.

Figure 3:
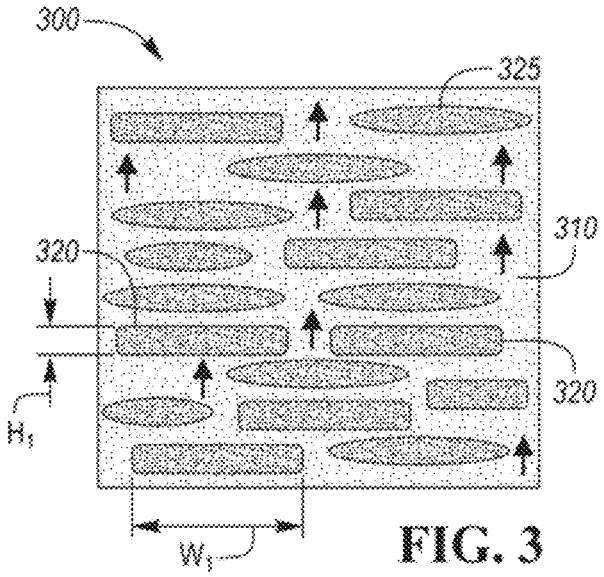
FIG. 3 is a schematic diagram of a composite permanent magnet according to an embodiment.

Referring to FIG. 3, a permanent magnet 300 is shown according to an embodiment. Permanent magnet 300 includes a magnetically hard phase 310 and a magnetically soft phase 320. The magnetically hard phase 310 may be, but is not limited to, NdFeB, SmCo5, MnBi, Sm—Fe—C, or other suitable permanent magnet materials or compounds, or combinations thereof. The magnetically soft phase 320 may be, but is not limited to, Fe, Co, FeCo, Ni, or combinations thereof. The magnetically soft phase may, in some embodiments, be a semi-hard magnetic phase, such as, but not limited to, Al—Ni—Co, Fe—N, an L10-material, Mn—Al, Mn—Al—C, Mn—Bi, or other similar materials. Furthermore, in some embodiments, the hard phase may comprise a combination of materials, such as, but not limited to, a composite of Nd—Fe-B+a-Fe(Co), and may include an adjustable content of Fe(Co), SmCo+Fe(Co), off-eutectoid SmCo, NdFeB alloys, or other similar materials. The magnetically soft phase 320 is incorporated into the magnetically hard phase 310 such that the average grain size of the magnetically soft phase 320 is larger than conventional permanent magnets. The arrows in the hard phase of FIG. 3 schematically show the crystallographic texture of the magnetically hard phase, i.e., that the c-axis of the magnetically hard phase grains is aligned. Hereinafter, average grain size is referred to interchangeably as "grain size," and is defined as a minimum dimension of the particle (e.g., the average diameter of a sphere, etc.). In some embodiments, the magnetically hard phase may have a grain size of 10 nm to 100 μm, in some embodiments, 50 nm to 50 μm, and in other embodiments 75 nm to 25 μm. However, although exemplary ranges are provided, it is noted that the magnetically hard phase may have any suitable grain size on the scale of tens of nanometers to tens of microns. The grain size and shape of the magnetically soft phase 320 provides improved magnetic performance in the final permanent magnets. In order to achieve good coupling between the magnetically hard and magnetically soft phases, the shape of the magnetically soft phase may be an elongated shape, such as, but not limited to, an elliptical shape, flake shape, or layered shape. In certain embodiments, the magnetically soft phase grains have a grain size of at least 50 nm, in other embodiments 50 to 1000 nm, and in yet other embodiments, at least 75 nm. In certain embodiments, the magnetically soft phase has an average grain height H1 of 20 to 500 nm, in some embodiments 30 to 200 nm, and in other embodiments 50 to 500 nm. Furthermore, in certain embodiments, the magnetically soft phase has an average grain width W1 of at least 50 nm, in some embodiments at least 100 nm, and in other embodiments 100 to 1000 nm.

Figure 4:
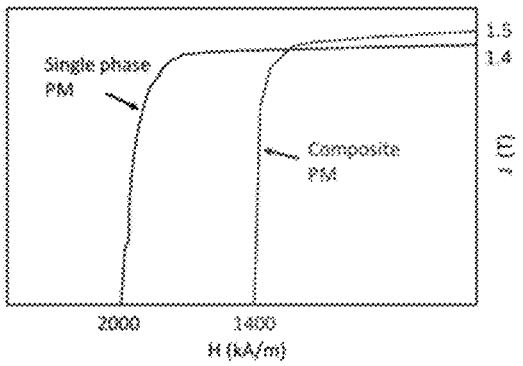
FIG. 4 is a graph showing the hysteresis loop for a composite permanent magnet according to an embodiment.

The shape of grains may affect performance in numerous ways, such as, but not limited to, improving grain boundaries, providing high texture areas, providing magnetic aesthetic interaction resulting in grain elongation. The magnetically soft phase 320 is shown as a rectangular shape, but may be any suitable shape, such as, but not limited to, an oval or elliptical shape 325, a layered shape (not shown), or a flake shape (not shown). The magnetically soft grains may include a mixture of the rectangular shapes 320 and the oval shapes 325, or include all grains of a single shape. In some embodiments, the magnetically soft phase 320 has a spherical shape having a diameter of smaller than the width of the elongated grains. For example, in some embodiments, the diameter may be less than 500 nm, and in other embodiments the diameter may be less than 250 nm. In certain embodiments, the elongated shape of the magnetically soft grains can be characterized by an aspect ratio of the grains as a ratio of grain width (W) (or length) to grain height (H). In some embodiments, the magnetically soft phase has a grain aspect ratio greater than 2:1, and in other embodiments the grain aspect ratio is greater than 10:1. Furthermore, in certain embodiments, the magnetically hard phase 310 has a crystallographic texture. In some embodiments, the magnetically soft phase 320 has a crystallographic texture. Because of the high flux provided by the magnetically soft phase, as shown by the hysteresis loop in FIG. 4, the saturated polarization and remanence of the resulting permanent magnet can be improved. Further, because of the increased dimension (or average grain size) of the magnetically soft phase grains, a composite magnet with magnetically hard and soft phases can be produced with improved texture, which cannot be realized in conventional permanent magnets.

Figure 5:
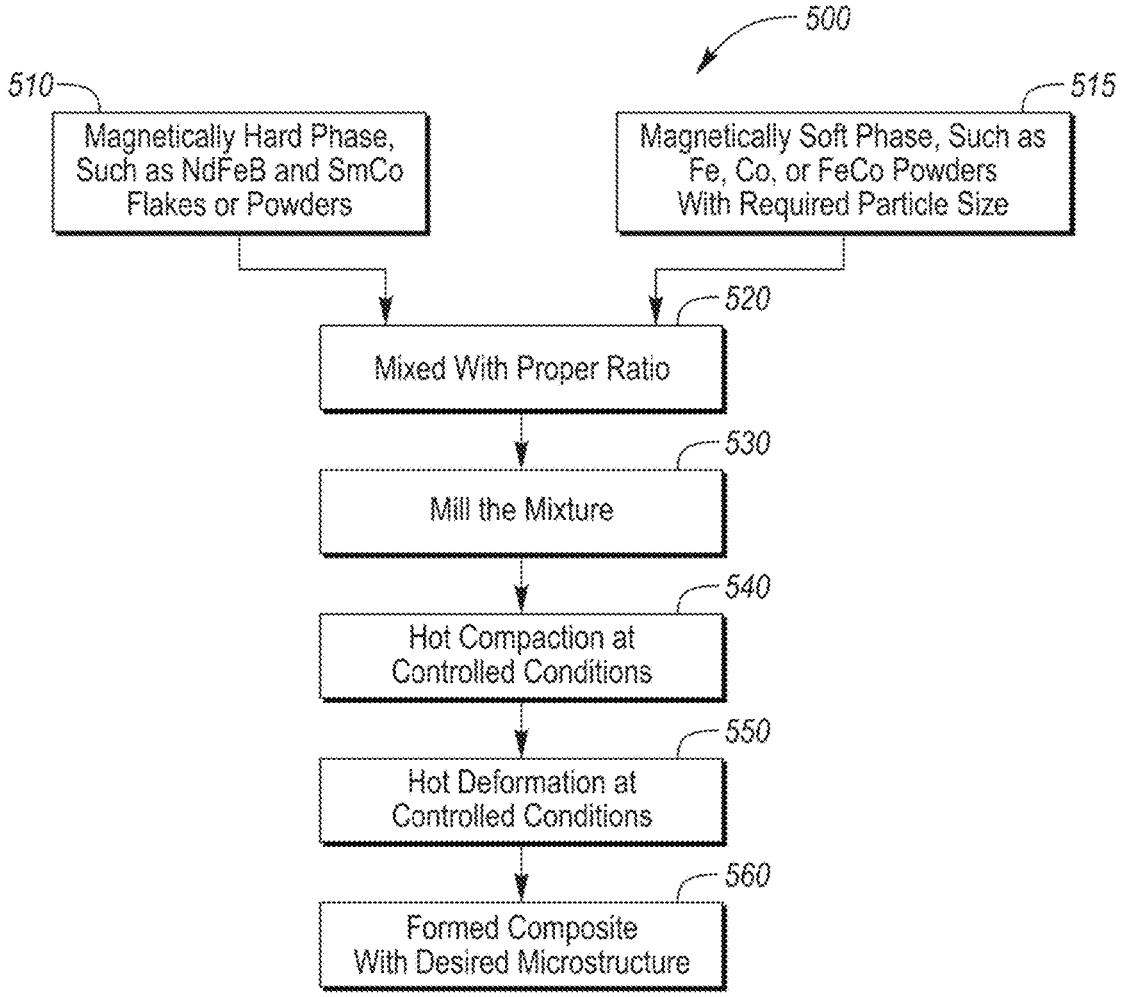
FIG. 5 is a flow chart showing a method of forming a composite permanent magnet according to an embodiment.

According to at least one embodiment, a method 500 for forming a permanent magnet having hard and soft phases is disclosed, as shown in FIG. 5. At step 510, a flakes or powders of a magnetically hard phase is provided. The flakes or powders of the magnetically hard phase may be prepared by any suitable technique to achieve initial magnetically hard phases with small grain size, such as, but not limited to, melt-spinning. By utilizing a small grain size in the magnetically hard phase, the desired grain growth can be better controlled during subsequent processing steps. In embodiments where the magnetically hard phase is in powder form, the powder may be an HDDR powders having a nano-scale grain size. The magnetically hard phase may be, but is not limited to, Nd—Fe—B and Sm—Co. At step 515, the soft magnetic phase is provided. The soft magnetic phase may be an elliptical, elongated, spherical, or flaked shape, and may be provided as a powder or as flakes. The powders or flakes of the magnetically soft phase, may be, but are not limited to, Fe, Co, or Fe—Co, and may have a particle size of 50 nm to 10 μm.

At step 520, powder or flakes of the magnet hard phase from step 510 are mixed with powder or flakes of the magnetically soft phase from step 515 (e.g., Fe and/or Fe—Co) to form a mixture. In one or more embodiments, to achieve improved remanence and coercivity, the mixture may include up to 50% wt. of the magnetically soft phase, and in certain embodiments, 10 to 30% wt. of the magnetically soft phase.

At step 530, the mixture is then milled to produce the strip microstructure of the grains of the soft phase, without destroying the hard phase. In order to achieve the desired structure, the magnetically soft phase may have certain properties, such as, but not limited to, good ductility. Examples of materials for the magnetically soft phase include, but are not limited to, Fe, Co, and Fe—Co, or other similar materials having good ductility. In one or more embodiments, milling step 530 further includes ball-milling before compaction and deformation. In certain embodiments, the mixture is milled to form magnetically soft Fe and/or Fe—Co grains having an average grain size of 200 nm to 500 nm. In at least one embodiment, the mixture is not milled, and merely shaken or mixed.

Figure 6:
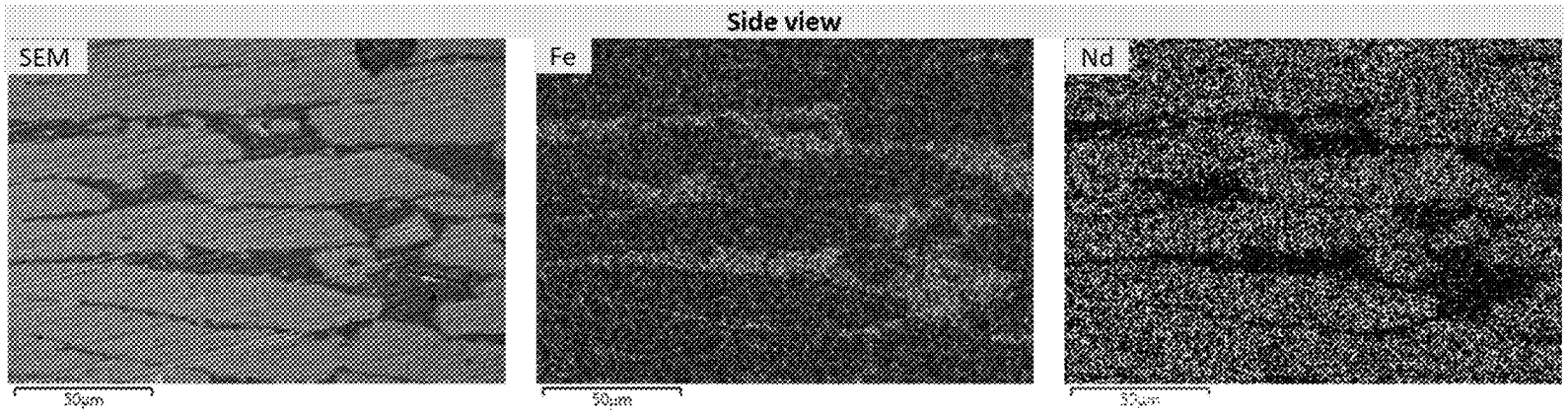
FIG. 6 shows the scanning-electron map (SEM) and Fe, Nd element maps of the structure of a composite permanent magnet without ball-milling according to an embodiment.
Figure 7:
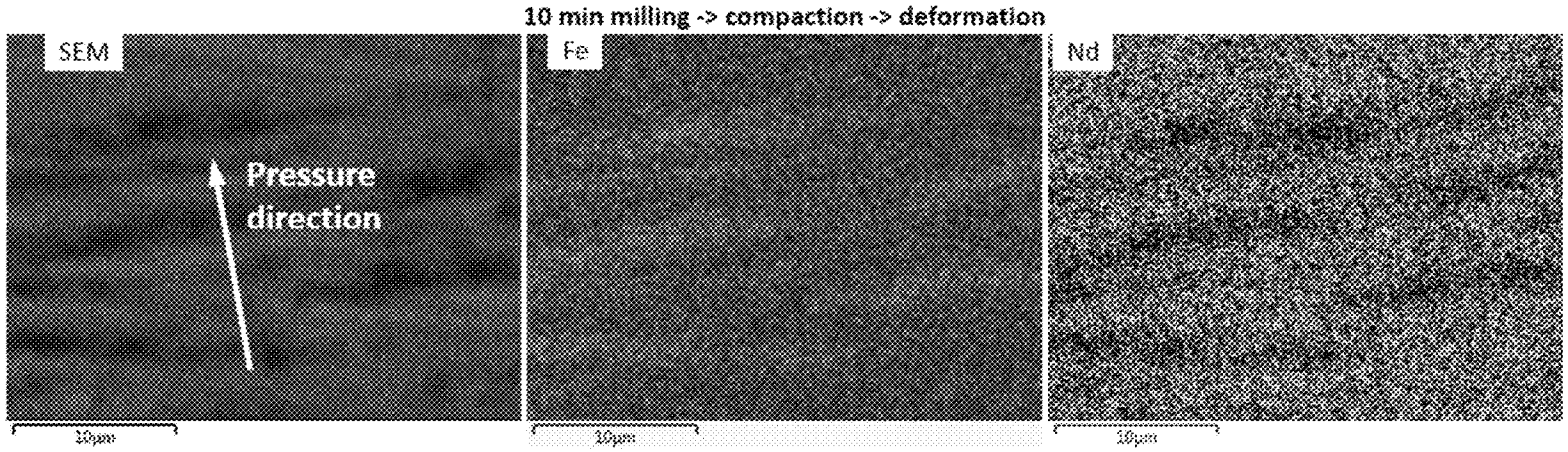
FIG. 7 the scanning-electron map (SEM) and Fe, Nd element maps of the structure of a composite permanent magnet with ball-milling according to an embodiment.

FIGS. 6-7 show the SEM and Fe/Nd element maps of the hot deformed permanent magnets, illustrating that the grain size and shape of the magnetically soft phase can be controlled through the ball-milling process. FIG. 6 shows the element maps without ball-milling, and FIG. 7 shows the element maps with 10 minutes of ball-milling. In embodiments where the mixture is milled, the milling may be limited to avoid destruction of the microstructure of the magnetically hard phase. In at least one embodiment, the mixture is milled for at least 5 minutes, and in other embodiments, 10 to 20 minutes. In embodiments where the mixture undergoes high energy ball milling, the ball milling time may be up to 60 minutes. However, it should be noted that milling time depends on numerous parameters, such as ball to material ratio, ball milling intensity, etc.

The milled mixture is then processed to produce the shape and texture of the permanent magnet. The processing to produce the desired shape and texture may include, for example, compacting at step 540, and hot-deforming the mixture at step 550. In certain embodiments, the shape and texture of the permanent magnet includes a strip structure, where the grain size of the composite phases is critical to performance. The hot compaction at step 540 may be controlled by temperature, pressing time, and pressing pressure, wherein each parameter may be dependent on the other parameters. For example, in some embodiments, where the temperature could be 550 to 800° C., the pressing time may be from 5 to 30 minutes, and the pressure may be 100 MPa to 2 GPa. Similarly, the hot deformation step 550 may be controlled by temperature, time, pressure, and deformation speed. For example, in some embodiments, the temperature may be 600 to 850° C., the pressing may be 5 to 60 minutes, and the pressure may be 100 MPa to 1 GPa. The deformation speed is thus controlled by the pressure increasing speed or the displacement speed of the press ram. With the hot compaction and hot deformation process, a crystallographic microstructure texture of magnetically hard phase may be developed at step 560.

According to embodiments of the present disclosure, a composite permanent magnet includes a magnetically hard phase and magnetically soft phase, wherein, in some embodiments, the grain size of the magnetically soft phase may be larger than 50 nm. Furthermore, the grain shape of the composite permanent magnet may be an elongated shape, such as, but not limited to, an oval shape, an elliptical shape, a layered shape, a flake shape, or a spherical shape (with a controlled diameter). The composite permanent magnet has improved texture formation (e.g., anisotropy) when compared to conventional nanocomposite permanent magnets because of the size and shape difference between the grains of the magnetically hard and soft phases. Furthermore, the microstructure of the magnetically hard and soft phases provides a good coupling, thus improving performance, such as remanence and energy product, of the composite permanent magnet.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A composite permanent magnet comprising:

a matrix of magnetically hard phase grains having an average grain size of 10 nm to 50 μm, the magnetically hard phase grains having an aligned crystallographic texture defined along a c-axis of the matrix; and magnetically soft phase grains embedded within the matrix, and having an average grain width of at least 50 nm defined along an x-axis of the grain and an average grain height of 20 to 500 nm, each soft phase grain having an elongated shape selected from ovals, ellipticals, rectangles, flakes, or combinations thereof, with an aspect ratio of at least 2:1, wherein the soft phase grains have a mixture of two or more shapes and the x-axis defines an alignment direction perpendicular to the aligned crystallographic texture of the matrix, and the magnetically soft phase grains are a magnetically soft material or a semi-hard magnetic material.

2. The composite permanent magnet of claim 1, wherein the magnetically hard phase grains are NdFeB, $SmCo_5$, MnBi, Sm—Fe—C, or combinations thereof.

3. The composite permanent magnet of claim 1, wherein the magnetically soft material is Fe, Co, FeCo, Ni, or combinations thereof, and the semi-hard magnetic material is Al—Ni—Co, Fe—N, an L10-material, Mn—Al, Mn—Al—C, or Mn—Bi.

4. The composite permanent magnet of claim 1, wherein the magnetically soft phase grains have an average grain height of 30 to 200 nm defined along a y-axis of the grain.

5. The composite permanent magnet of claim 1, wherein the aspect ratio is at least 10:1.

6. The composite permanent magnet of claim 1, wherein the magnetically soft phase grains include a mixture of oval grain shapes and rectangle grain shapes.

7. A composite permanent magnet comprising:

a matrix of magnetically hard phase grains having an average grain size of 10 nm to 50 μm, the magnetically hard phase grains having an aligned crystallographic texture defined along a c-axis of the matrix; and magnetically soft phase grains of a semi-hard magnetic phase material, a soft material, or combinations thereof embedded within the matrix, and having an average grain width defined along an x-axis of the grain, an average grain height of 20 to 500 nm defined along a y-axis of the grain, and an aspect ratio of at least 10:1 and the magnetically soft phase grains having a mixture of two or more shapes selected from ovals, ellipticals, rectangles, flakes, or combinations thereof, wherein the semi-hard magnetic phase material is Al—Ni—Co, Fe—N, an L10-material, Mn—Al, Mn—Al—C, or Mn—Bi, and the x-axis of the magnetically soft phase grains defines an alignment direction perpendicular to the aligned crystallographic texture of the matrix.

8. The composite permanent magnet of claim 7, wherein the magnetically hard phase grains are NdFeB, SmCo5, MnBi, Sm—Fe—C, or combinations thereof.

9. The composite permanent magnet of claim 7, wherein the soft material is Fe, Co, FeCo, Ni, or combinations thereof.

10. The composite permanent magnet of claim 7, wherein the two or more shapes includes oval shapes and rectangular shapes.

11. A method of forming a composite permanent magnet comprising:

providing magnetically hard phase grains having an average grain size of 10 nm to 50 μm and an average grain height of 20 to 500 nm, and a mixture of two or more shapes of magnetically soft phase grains with each soft phase grain having an elongated shape selected from ovals, ellipticals, rectangles, flakes, or combinations thereof and having an average grain width of at least 50 nm defined along an x-axis of the grain and an aspect ratio of at least 2:1;

mixing the magnetically hard and soft phase grains at a ratio of up to 50% wt. of the magnetically soft phase grains to form a mixture;

hot-compacting the mixture to form a compact; and hot-deforming the compact to form a composite permanent magnet with elongated magnetically soft phase grains embedded in a magnetically hard phase matrix, wherein the magnetically hard phase matrix has an aligned crystallographic texture defined along a c-axis of the matrix, and the x-axis defines an alignment direction of the magnetically soft phase grains perpendicular to the c-axis.

12. The method of claim 11, wherein the magnetically soft phase grains have an average grain height of 30 to 200 nm.

13. The method of claim 11, wherein the aspect ratio is at least 10:1.

14. The method of claim 11, wherein the hot-compacting is conducted at a temperature of 550-800° C., for a pressing time of 5 to 30 minutes, under a pressure of 100 MPa to 2 GPa.

15. The method of claim 11, wherein the hot-deforming is conducted at a temperature of 600-850° C., for a pressing time of 5 to 60 minutes, under a pressure of 100 MPa to 1 GPa such that a deformation speed is controlled by a pressure increasing speed or a press ram displacement speed.

16. The method of claim 11, further comprising milling the mixture without destroying a microstructure of the magnetically hard phase grains.

17. The method of claim 11, wherein the magnetically hard phase grains are NdFeB, SmCo5, MnBi, Sm—Fe—C, or combinations thereof, and the magnetically soft phase grains are Fe, Co, FeCo, Ni, or combinations thereof.

* * * * *